United States Patent [19]

Fujita

[11] 4,014,164

[45] Mar. 29, 1977

[54] ELECTRONIC TIMEPIECE INCLUDING BATTERY MONITORING ARRANGEMENT

[75] Inventor: Kinji Fujita, Suwa, Japan

[73] Assignee: Kabushiki Kaisha Suwa Seikosha, Tokyo, Japan

[22] Filed: Mar. 27, 1975

[21] Appl. No.: 562,517

[30] Foreign Application Priority Data

Mar. 27, 1974 Japan ..... 49-34241

[52] U.S. Cl. ..... 58/23 BA; 58/152 H

[51] Int. Cl.[2] ..... G04C 3/00

[58] Field of Search ..... 58/23 BA, 23 R, 23 A, 58/23 AC, 50 R, 152 H

[56] References Cited

UNITED STATES PATENTS

| | | | |
|---|---|---|---|
| 3,898,790 | 8/1975 | Takamune et al. | 58/23 BA |
| 3,962,859 | 6/1976 | Ito | 58/23 BA |

*Primary Examiner*—Stanley J. Witkowski

*Attorney, Agent, or Firm*—Blum, Moscovitz, Friedman & Kaplan

[57] ABSTRACT

An electronic timepiece including a battery monitoring arrangement wherein the irregular movement of the second hand is utilized to monitor the effective voltage of a battery utilized to energize same is provided. The timepiece includes oscillator circuitry producing a high frequency time standard signal and divider circuitry including a plurality of divider stages adapted to produce low frequency signals in response to the high frequency signal, and batteries coupled to the oscillator circuitry and divider circuitry for energizing same. A step motor includes a rotor adapted to be rotated in response to each driving pulse applied thereto. The display includes a second hand rotated in response to each rotation of the rotor. The battery monitoring circuit is characterized by a voltage detection circuit coupled to the battery for detecting the effective voltage thereof, and producing a signal in response to a drop in the effective voltage below a predetermined level. A monitoring circuit is coupled to the detection circuit and the divider circuit for receiving the slow frequency signals and in response thereto applying periodic drive pulses to the step motor to effect a first periodic rotation of the rotor, the monitoring circuit being further adapted to apply different periodic drive pulses to the step motor in response to the signal applied from the detecting circuit to effect a second and different periodic rotation of the rotor.

12 Claims, 3 Drawing Figures

10
12
14
16
18
20
FF1
FF2
FFk
FFn
FFn+1
FFn+2
I1
I2
I3
I4
I5
I6
O1
O2
A1
A2
A3
R1
R2
C1
C2
X
f0
L
C
S
W
H
B
D
T
P

ELECTRONIC TIMEPIECE INCLUDING BATTERY MONITORING ARRANGEMENT

BACKGROUND OF THE INVENTION

This invention is directed to an electronic timepiece including a battery monitoring arrangement, and in particular to an electronic timepiece wherein a second hand is rotated in an uncharacteristic manner to indicate a drop in the effective voltage of the battery below a reference voltage level.

Heretofore, accurately predicting with any degree of certainty the life of a battery, or accurately monitoring a drop in the effective voltage of a battery when such battery was being used in an electronic wristwatch has not been satisfactorily achieved. Although the life of a battery utilized in an electronic timepiece extends from one to two years, the suggested replacement dates are usually ignored or forgotten due to the lengthy duration between such needed replacements of the battery therein. Although different manners of effecting monitoring of the effective voltage of the battery in a timepiece, such as voltage meters or display cells have been suggested, such methods of monitoring the battery have been less than completely satisfactory. For example, movable coil type meters and/or light emitting diodes have been proposed, but such arrangements are not practical in view of the limited space in minimum power requirements of small sized electronic timepieces such as wristwatches. Accordingly, an arrangement for monitoring a battery wherein limited power is required, and wherein additional display elements are not needed is desired.

SUMMARY OF THE INVENTION

Generally speaking, in accordance with the invention, an electronic timepiece includes a battery monitoring arrangement wherein the second hand is rotated in an uncharacteristic manner to indicate a reduction in the effective voltage of the battery below a predetermined voltage level. An oscillator circuit is provided for producing a high frequency time standard signal and a divider circuit includes a plurality of divider stages adapted to produce low frequency signals in response to a high frequency signal applied thereto. A battery is coupled to the oscillator circuit and divider circuit for energizing same. A step motor includes a rotor adapted to be rotated in response to each driving pulse supplied thereto, and a display includes at least one hand rotated in response to each rotation of the rotor. The battery monitoring circuit is particularly characterized by a detection circuit coupled to the battery for detecting the voltage thereof, the detecting circuit producing a signal in response to detection of a voltage below a predetermined voltage level. A monitoring circuit is coupled to the detection circuit and additionally to the divider circuit for receiving the low frequency signals produced thereby and in response thereto applies periodic drive pulses to the step motor to effect a first periodic rotation of the rotor, the monitoring circuit being further adapted to apply different periodic drive pulses to the step motor in response to a detection signal produced by the detection circuit to effect a second and distinct periodic rotation of the rotor.

Accordingly, it is an object of this invention to provide an electronic timepiece having an improved battery monitoring arrangement.

Another object of the instant invention is to provide an improved electronic timepiece battery monitoring arrangement wherein the effective voltage of the battery is monitored without the use of any further display elements.

Still a further object of the instant invention is to provide an improved electronic timepiece battery monitoring arrangement wherein the second hand is rotated in an uncharacteristic periodic fashion to thereby indicate a drop in the effective voltage of the battery.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
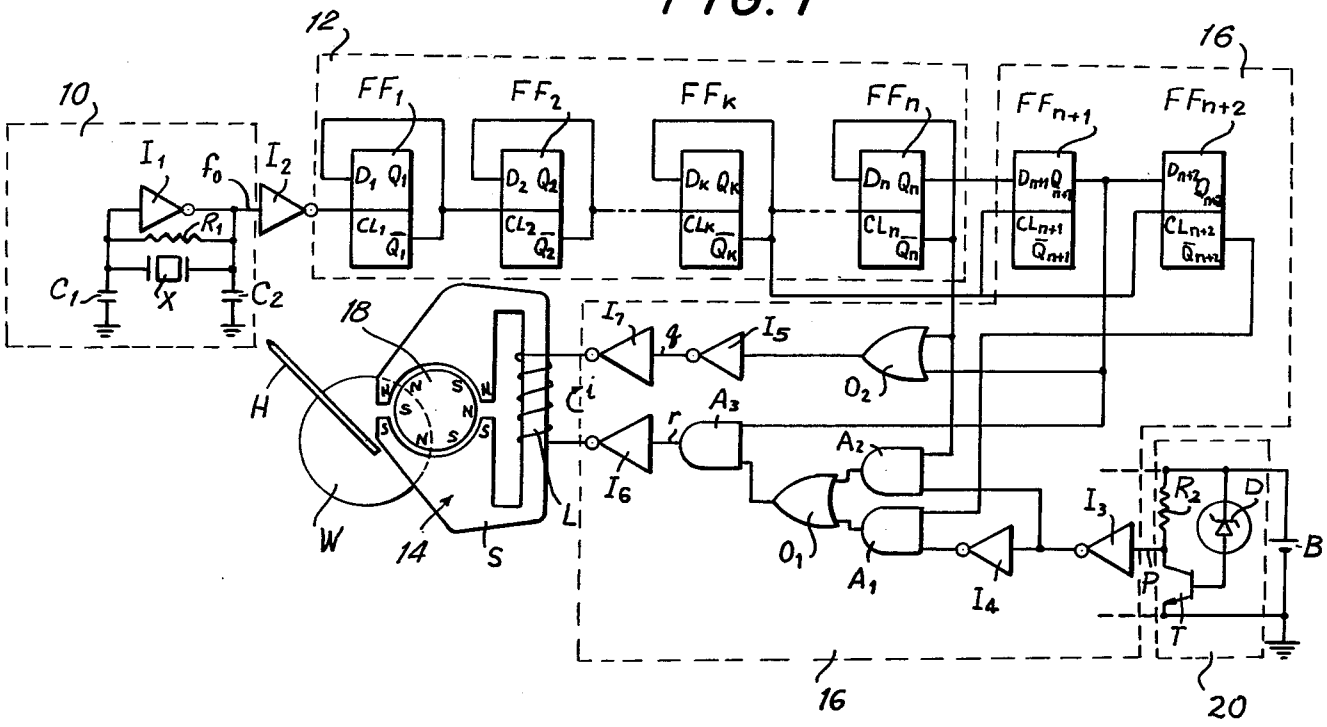
FIG. 1 is a detailed circuit diagram of an electronic timepiece including a battery monitoring arrangement constructed in accordance with the instant invention.

Reference is now made to FIG. 1, wherein an electronic timepiece including a battery monitoring arrangement constructed in accordance with the instant invention is depicted. The electronic timepiece includes an oscillator circuit, generally indicated as 10, which oscillator circuit includes an inverter circuit I having a feedback resistor $R_1$ and quartz crystal vibrator X coupled in parallel across the output and input terminals thereof in a conventional manner. The input and output terminals of the oscillator circuit are respectively coupled to a reference potential such as ground through capacitors $C_1$ and $C_2$. The quartz crystal oscillator circuit 10 produces a high frequency time standard signal on the order of $2^{32}$ Hz (32,768 Hz) $f_0$, which signal $f_0$ is applied to an amplifying inverter $I_2$.

Figure 2:
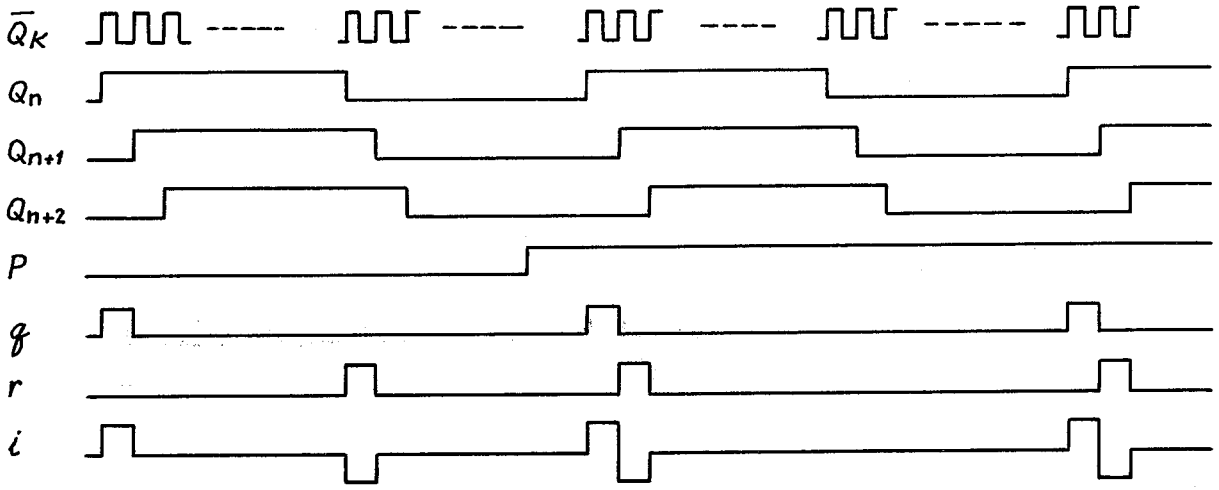
FIG. 2 is a wave diagram of the pulses produced by the electronic timepiece circuit depicted in FIG. 1.

The amplified and inverted signal $f_0$ produced by inverter $I_2$ is applied to a divider circuit, generally indicated as 12, comprised of a plurality of D-type flip-flop circuits $FF_1$ to $FF_n$ coupled to define binary divider circuit 12, for receiving $f_0$ and in response thereto providing an output signal $Q_n$, depicted in FIG. 2 having a period of two seconds. A battery monitoring circuit, generally indicated as 16, includes two further D-type flip-flops $FF_{n+1}$ and $FF_{n+2}$. Both flip-flops $FF_{n+1}$ and $FF_{n+2}$ are coupled to D-type flip-flops $FF_K$ to receive an intermediate frequency signal $\overline{Q}_K$ produced by intermediate frequency flip-flop $FF_K$. Additionally, flip-flop $FF_{n+1}$ has applied to the D terminal thereof two second pulse $Q_n$ produced by flip-flop $FF_n$. In response to intermediate frequency signal $\overline{Q}_K$ and $Q_n$, flip-flop $FF_{N+1}$ applies to the D terminal of flip-flop $FF_{n+2}$ a signal $Q_{n+1}$ having the same period as $Q_n$ but delayed by a period equal to the period of intermediate frequency signal $\overline{Q}_K$. The flip-flops $FF_{n+1}$ and $FF_{n+2}$ produce the above mentioned signals $Q_{n+1}$ and $\overline{Q}_{n+2}$ respectively, which signals are differentiated by the battery monitoring circuit 16 to generate drive pulses to effect rotation of the rotor in the manner to be hereinafter discussed. It is noted that $\overline{Q}_{n+2}$ is the complement of the signal $Q_{n+2}$ illustrated in FIG. 2.

Figure 3:
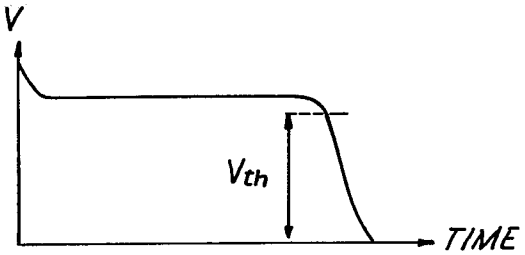
FIG. 3 is a graphical illustration of the voltage discharge characteristic of the battery B depicted in FIG. 1.

The electronic timepiece of FIG. 1 includes a battery detection circuit, generally indicated as 20, coupled to a battery B. Battery B is adapted to energize the oscillator circuit 10, divider circuit flip-flops $FF_1$ through $FF_n$ and additional flip-flops $FF_{n+1}$ and $FF_{n+2}$ in the usual manner. The discharge characteristic of the battery B is particularly illustrated in FIG. 3. It is noted, that over a period of time the effective voltage of the battery remains fairly stable, until the battery begins to discharge. Thereafter, the effective voltage of the battery becomes rapidly diminished by comparison to the time over which same remains fairly stable.

Detection circuit 10 includes a Zener diode D is coupled to the effective potential electrode of the battery B and the base of a transistor T, which transistor has a collector emitter path including a bias resistor R2 coupled in parallel with the battery B. Accordingly, when the potential of the battery B effects a voltage above the threshold voltage Vth determined by the Zener diode D, the Zener diode maintains the base electrode of the transistor at a lower potential than the effective potential of the battery, thereby referencing the collector potential P of the transistor T at a reference potential such as ground. Nevertheless, when the battery life nears its end, the effective voltage thereof drops below the threshold voltage determined by the Zener diode D, hence causing a termination of base current and thereby referencing the collector potential P to a higher potential as is specifically depicted in FIG. 2. The rise in potential P is detected by the novel logic circuit arrangement and is combined with the signals produced by flip-flops $FF_n$, $FF_{n+1}$ and $FF_{n+2}$ to thereby produce an uncharacteristic driving pulse in a manner to be discussed more fully below with respect to the operation of the instant invention.

A conventional hands display arrangement including a stepping motor, generally indicated as 14, is provided. A step motor including stator poles S having a drive coil L wrapped therearound effect a stepping of the rotor 18 in response to drive pulses applied to coil L. The rotor is mechanically coupled to a rotary wheel W having second hand H mounted thereto, the wheel being adapted to affect rotation of the second hand H in response to each rotation of the rotor 18. The rotor 18 is divided into six magnetic poles and is rotated 60° in response to each drive pulse applied to the drive coil L. The rotor 18 and gear wheel W are provided with a reduction ratio in order to effect a stepwise displacement of the second hand H once each second during normal operation of the timepiece.

During normal operation of the electronic timepiece depicted in FIG. 1, wherein the effective voltage of the battery B remains above the threshold level determined by the Zener diode D, the voltage detection circuit 20 produces a signal P having a low potential. Accordingly, the low potential P is applied through inverter $I_3$ to AND GATE $A_z$ and maintains a first input of AND GATE $A_2$ open by applying a "1" to the input thereof, and is applied through inverter $I_4$ to a first input of AND GATE $A_4$ and maintains AND GATE $A_1$ closed by applying a "0" thereto. Accordingly, AND GATE $A_2$ applies signal $\overline{Q}_n$ to OR GATE $O_1$, and in view of the other input to gate $O_1$ being maintained at zero by the closing of gate $A_1$, signal $\overline{Q}_n$ is applied as a first input to AND GATE $A_3$. The other input to AND GATE $A_3$ is differentiated signal $Q_{n+1}$ produced by flip-flop $FF_{n+1}$ to thereby produce a pulse *r* once each second having a pulse width equal to the period of the high frequency signal $\overline{Q}_K$ once every two seconds, which pulse is inverted by inverter $I_6$ and applied as uni-polarity pulses *i* to the drive coil L of the step motor 14. Additionally, pulse *q* is derived by applying the pulse $\overline{Q}_n$ from flip-flop $FF_n$ and $Q_{n+1}$ from flip-flop $FF_{n+1}$ to OR GATE $O_2$ which gate compares the signals and applies a pulse to inverter circuit $I_5$ which applies pulses *q* to inverter $I_7$ which, in turn converts same and applies the pulse as a uni-polarity drive pulses *i* to the drive coil L of the step motor 14. Accordingly, when the potential P of the collector of the transistor T is maintained at a low or reference potential, a drive signal *i* is applied to the drive coil of the step motor to effect an opposite polarity pulse applied thereto once each second. By providing a reduction ratio between the rotor 18 and the wheel W of 1/10, the second hand H is rotated once each second in direct response to a 60° rotation of the rotor once each second.

When the effective voltage of the battery B falls below the threshold voltage determined by the Zener diode D, the potential of the voltage detecting transistor T is referenced to a higher potential as specifically indicated by P in FIG. 2. Accordingly, inverters $I_3$ and $I_4$ effect a "1" input to gate $A_1$ effecting an opening thereof for transmission of pulse $\overline{Q}_{n+2}$ produced by flip-flop $FF_{n+2}$ to OR GATE $O_1$. Additionally, the inverter $I_3$ affects a "0" input to gate $A_2$ and hence a closing thereof to thereby provide no input to gate $O_1$. Accordingly, gate $A_3$ provides an AND operation on the signals $\overline{Q}_{n+2}$ and $Q_{n+1}$ to thereby produce a pulse *r* in the manner depicted in FIG. 2. Because the change in potential of the collector terminal P does not have an effect on the pulses *q*, the resultant drive pulses *i* provide for a positive going pulse immediately followed by a negative going pulse once every two seconds applied to the drive coil L. Accordingly, the rotor 18 is stepped twice at the beginning of each two second period, whereafter same is not rotated again until two seconds later. As noted above, because the second hand is controlled by the rotation of the rotor, the second hand is rotated twice at the beginning of each two second period whereafter same remains stationary for a better part of the two second period. Accordingly, rotation of the rotor by 120° affects an uncharacteristic stepwise advance of the second hand, which when observed will indicate that the battery must be replaced within a short while. It is noted, that although the second hand is uncharacteristically advanced, it is advanced by two seconds each two seconds and hence correctly indicates the time at the moment that it is advanced. Moreover, because the battery will continue to discharge over a period of several days to several weeks, the battery can be conveniently replaced while the timepiece is still accurately displaying time.

It is noted, that the instant invention merely requires additional circuit elements easily integrated into a circuit chip and hence utilizing a minimum of power, and further utilizing little space. Moreover, battery monitoring is effected by use of conventional display elements already present in conventional electronic timepieces. Accordingly, by providing different driving pulses produced by differentiating signals produced by flip-flop counters when the effective voltage of the battery falls below a reference potential, the driving pulse applied to the step motor is changed, thereby providing an uncharacteristic movement of the second hand to provide an indication that the battery needs replacement.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece having a battery monitoring arrangement and including oscillator means for producing a high frequency time standard signal, divider means including a plurality of series-connected divider stages adapted to produce low frequency signals in response to said high frequency signal applied thereto, a battery coupled to said oscillator means and said divider means for energizing same, a stepping motor including a rotor adapted to be rotated in response to each driving pulse applied to the step motor, and a display means including at least one hand adapted to be rotated in response to each rotation of said rotor, the improvement comprising detection means coupled to said battery for detecting the potential thereof, said detecting means producing a signal in response to detecting a potential below a predetermined level, and monitoring circuit means coupled to said detection means and to said divider means for receiving said low frequency signals and in response thereto, applying periodic drive pulses to said step motor to effect a first periodic rotation of said rotor and thereby effect a first periodic advancing of said hand, said monitoring circuit means being further adapted to apply different periodic drive pulses to said step motor in response to a signal applied from said detection means to effect a second and different periodic rotation of said rotor and thereby effect a second and different advancing of said hand to indicate said battery potential being below a predetermined level.

2. An electronic timepiece as claimed in claim 1, wherein said detection means includes a fixed reference voltage means for determining said predetermined potential level, and in response thereto produce said detection signal.

3. An electronic timepiece as claimed in claim 2, wherein said low frequency signals produced by said divider means are a low frequency time keeping signal produced by one of the series-connected divider stages and an intermediate frequency signal produced by an intermediate divider stage, said monitoring circuit means including differentiation means for producing the first mentioned and further periodic drive pulses having a pulse width equal to the pulse width of said intermediate frequency signal.

4. An electronic timepiece as claimed in claim 3, wherein said differentiation circuit means includes first and second series-connected circuit means adapted to receive said intermediate frequency signal and said low frequency time keeping signal, and in response thereto respectively produce a first differentiation signal having the same period as said low frequency time keeping signal and delayed by a period equal to said intermediate frequency signal, and a second differentiation signal having the same period as said time keeping signal and first differentiation signal but delayed from said first differentiation signal by a period equal to said intermediate frequency signal.

5. An electronic timepiece as claimed in claim 4, wherein said differentiation means further includes first logic gating means adapted to receive said time keeping signal and said first differentiation signal and in response thereto produce a drive pulse having a period equal to said time keeping signal and a pulse width equal to said intermediate frequency signal, and second logic gating means coupled to said detection circuit means, and adapted to receive said time keeping signal and said first and second differentiation signals, and in response to the absence of a detection signal applied thereto effects a comparison of said time keeping signal and said first differentiation signal to produce drive pulses having a pulse width equal to said intermediate frequency signal and a period equal to said time keeping signal but delayed by one-half the period of said drive pulses produced by said first logic gating means, and in response to said detecting signal compare said first and second differentiation signals and produced drive pulses having a pulse width equal to said intermediate frequency signal and a period equal to said time keeping signal immediately upon termination of each of said drive pulses produced by said first logic gating means.

6. An electronic timepiece as claimed in claim 5, wherein said step motor includes a drive coil wrapped around a stator and coupled at a first end to said first logic gating means and at a second end to said second logic gating means for effecting a stepping of the rotor in response to the application of said drive pulses applied thereto.

7. An electronic timepiece as claimed in claim 6, wherein said fixed reference voltages means includes a voltage limiting element coupled to said battery, and transistor switch means having a control electrode coupled to said voltage limiting means for providing said detection signal when the voltage of said battery drops below the fixed voltage of said voltage limiting element.

8. An electronic timepiece as claimed in claim 7, wherein said voltage limiting element is a Zener diode.

9. An electronic timepiece as claimed in claim 6, wherein said first and second series connected circuit means producing said first and second differentiation signals are D-type flip-flops.

10. An electronic timepiece as claimed in claim 6, wherein said first logic circuit means includes OR GATE means adapted to receive as a first input said low frequency time keeping signal and as a second input said first differentiation signal, and in response thereto produce said first logic gate means drive pulses.

11. An electronic timepiece as claimed in claim 10, wherein said second logic gate means includes first and second AND GATE means adapted to respectively receive as first inputs said detection signal, and an inverted detection signal, said first and second AND GATE means respectively having as the other input said time keeping signal and said second differentiation signal, and OR GATE means adapted to produce one of said time keeping signal in response to the absence of a detection signal produced by said detection circuit means and said second differentiation signal in response to said detection signal produced by said detection circuit means, and an AND GATE means adapted to receive as a first input said first differentiation signal, and as the other input the output of said OR GATE means to thereby produce said aforedescribed second logic gating means drive pulses to said drive coil.

12. An electronic timepiece as claimed in claim 1, wherein said display hand is a second hand, and said first mentioned periodic pulse effects a periodic rotation of said rotor once each second and a likewise stepwise rotation of said second hand once each second, and said different periodic drive pulses produced in response to said detection signal effects two immediate successive rotations of said rotor once every two seconds, and hence a rotation of said second hand in like manner.

* * * * *